US010746138B2

(12) United States Patent
Loya et al.

(10) Patent No.: US 10,746,138 B2
(45) Date of Patent: Aug. 18, 2020

(54) HOLLOW FIN TUBE STRUCTURE AT INLET OF EGR COOLER

(71) Applicant: Progress Rail Locomotive Inc., LaGrange, IL (US)

(72) Inventors: Sudarshan Kedarnath Loya, Naperville, IL (US); Steven D. Johnson, Naperville, IL (US); Vijaya Kumar, Naperville, IL (US); Laura Elise Rasmussen, Brookfield, IL (US); Adarsh Gopinathan Nair, Darien, IL (US); Michael B. Goetzke, Orland Park, IL (US)

(73) Assignee: Progress Rail Locomotive Inc., Albertville, AL (US)

( * ) Notice: Subject to any disclaimer, the term of this patent is extended or adjusted under 35 U.S.C. 154(b) by 180 days.

(21) Appl. No.: 15/967,134

(22) Filed: Apr. 30, 2018

(65) Prior Publication Data

US 2019/0331066 A1 Oct. 31, 2019

(51) Int. Cl.

| | |
|---|---|
| ***F01N 3/04*** | (2006.01) |
| ***F02M 26/29*** | (2016.01) |
| ***F01N 3/02*** | (2006.01) |
| ***F28D 21/00*** | (2006.01) |
| ***F28D 7/16*** | (2006.01) |

(52) U.S. Cl.

CPC ..... *F02M 26/29* (2016.02); *F01N 3/0205* (2013.01); *F28D 7/16* (2013.01); *F28D 21/0003* (2013.01)

(58) Field of Classification Search

CPC .... F01N 3/0205; F01N 3/0234; F01N 3/2889; F02M 26/29; F02M 26/32

See application file for complete search history.

(56) References Cited

U.S. PATENT DOCUMENTS

| | | | |
|---|---|---|---|
| 1,171,899 | A | 2/1916 | Still |
| 5,117,903 | A | 6/1992 | Oshiyama et al. |
| 9,631,876 | B2 | 4/2017 | Zima et al. |

FOREIGN PATENT DOCUMENTS

DE 102005034773 A1 * 2/2007 ..... F28D 7/1615

OTHER PUBLICATIONS

Machine translation of DE-102005034773-A1, accessed Dec. 20, 2019. (Year: 2019).*

* cited by examiner

*Primary Examiner* — Jonathan R Matthias

(74) *Attorney, Agent, or Firm* — Miller, Matthias & Hull LLP

(57) ABSTRACT

An EGR cooler may include an EGR cooler housing having top, bottom and side walls, inlet and outlet end walls disposed at opposite ends, and a longitudinal axis extending in a direction of exhaust gas flow from the inlet end to the outlet end. A plurality of cooling tubes extend through the EGR cooler between the top and bottom walls, and are arranged in a cooling tube array to form an exhaust gas receiving area at an upstream side of the cooling tube array proximate the inlet end wall so that exhaust gas flowing into the EGR cooler through an exhaust gas inlet opening will flow into the exhaust gas receiving area and then disperse through the cooling tube array. A pitch distance between the cooling tubes may be greater proximate the longitudinal axis than proximate the side walls to promote flow through, instead of around, the cooling tube array.

16 Claims, 6 Drawing Sheets

HOLLOW FIN TUBE STRUCTURE AT INLET OF EGR COOLER

TECHNICAL FIELD

The present disclosure relates generally to exhaust gas recirculation (EGR) coolers and, more particularly, to array configurations of cooling tubes in EGR coolers that promote exhaust gas flow through the cooling tube array to improved heat transfer efficiency of the EGR coolers.

BACKGROUND

Exhaust gas recirculation (EGR) is a technique for reducing nitrogen oxide (NOx) emissions from internal combustion engines. In EGR systems, a portion of an engine's exhaust gas is recirculated back to the engine cylinders. The recirculation of the NOx dilutes the O2 in the incoming air stream and provides gases inert to combustion to act as absorbents of combustion heat to reduce peak in-cylinder temperatures. In many EGR systems, the recirculated NOx is cooled by an EGR heat exchanger or cooler to allow the introduction of a greater mass of recirculated gas.

With the advent of Tier 4 emission standards, the use of after-treatment systems and other engine modifications like turbochargers, electronic control, EGR systems and the like has become even more common. Most engine manufacturers use high pressure EGR loops to avoid turbocharger fouling and other condensation issues in order to meet the emission requirements. The EGR cooler is one of the most important components of the EGR system, and fouling of the EGR cooler is among the most common reasons for engine failure.

Commonly used EGR coolers are designed for small engines, i.e., <1,000 HP, where exhaust gases flow inside tubes, and water or other cooling fluid is flown over the tubes inside the cooler housing. In contrast, in very large engines such as those used in marine and diesel locomotives, the placement of the fluids is reversed for maximum efficiency. In such implementations, the cooling fluid is flown inside cooling tubes and the exhaust gas is flown unconstrained over the cooling tubes and their fins. It is very common in these types of EGR coolers that the exhaust gas flow enters the EGR cooler through a narrow inlet opening that opens into a larger area of the EGR cooler upstream of an array of cooling tubes. In known EGR coolers, a meaningful portion of the exhaust gas flows around the cooling tube array through a path of least resistance through the EGR cooler housing. The flow of the exhaust gas around the cooling tube array reduces the heat transfer between the exhaust gas and the cooling fluid in the cooling tubes, and correspondingly reduces the heat transfer efficiency of the EGR cooler.

SUMMARY OF THE DISCLOSURE

In one aspect of the present disclosure, an EGR cooler is disclosed. The EGR cooler may include an EGR cooler housing having a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of an exhaust gas flow from the inlet end to the outlet end. The EGR cooler may further include a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes, wherein the cooling tube array is arranged to form an exhaust gas receiving area at an upstream side of the cooling tube array proximate the inlet end wall so that exhaust gas flowing into the EGR cooler through the exhaust gas inlet opening will flow into the exhaust gas receiving area and then disperse through the cooling tube array.

In another aspect of the present disclosure, an EGR cooler is disclosed. The EGR cooler may include an EGR cooler housing having a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of an exhaust gas flow from the inlet end to the outlet end. The EGR cooler may further include a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes. The cooling tube array is arranged in a plurality of tube rows that are perpendicular to the EGR cooler longitudinal axis with the cooling tubes of each of the plurality of tube rows being spaced from each adjacent cooling tube by a pitch distance between their tube longitudinal axes. The cooling tube array includes a first cooling tube array section proximate the EGR cooler longitudinal axis, wherein the pitch distance between the adjacent cooling tubes in the first cooling tube array section is equal to a first pitch distance, and a pair of second cooling tube array sections, with each second cooling tube array section being disposed between the first cooling tube array section and a corresponding one of the first side wall and the second side wall, and wherein the pitch distance between the adjacent cooling tubes in the pair of second cooling tube array sections is equal to a second pitch distance that is less than the first pitch distance.

In a further aspect of the present disclosure, an EGR cooler is disclosed. The EGR cooler may include a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of exhaust gas flow from the inlet end to the outlet end. The EGR cooler may further include a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes. The cooling tube array is arranged to form an exhaust gas receiving area at an upstream side of the cooling tube array proximate the inlet end wall so that exhaust gas flowing into the EGR cooler through the exhaust gas inlet opening will flow into the exhaust gas receiving area and then disperse through the cooling tube array. The cooling tube array is further arranged in a plurality of tube rows that are perpendicular to the EGR cooler longitudinal axis with the cooling tubes of each of the plurality of tube rows being spaced from each adjacent cooling tube by a pitch distance between their tube longitudinal axes, with the cooling tube array having a first cooling tube array section proximate the EGR cooler longitudinal axis, wherein the pitch distance between the adjacent cooling tubes in the first cooling tube array section is equal to a first pitch distance, and a pair of second cooling tube array sections, with each second cooling tube array section being disposed between the first cooling tube array section and a corresponding one of the first side wall and the second side wall, and wherein the pitch distance between the adjacent cooling tubes in the pair of second cooling tube array sections is equal to a second pitch distance that is less than the first pitch distance.

Additional aspects are defined by the claims of this patent.

DETAILED DESCRIPTION

Figure 1:
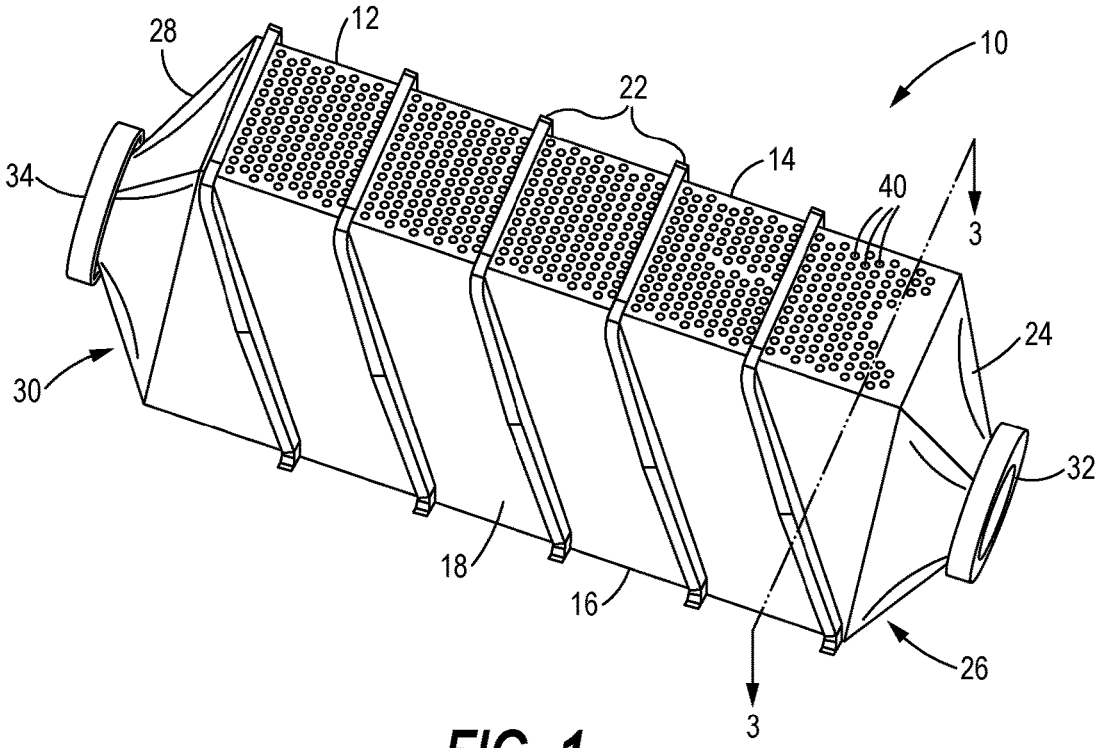
FIG. 1 is a top side isometric view of an EGR cooler in which cooling tubes may be arranged in accordance with the present disclosure.
Figure 2:
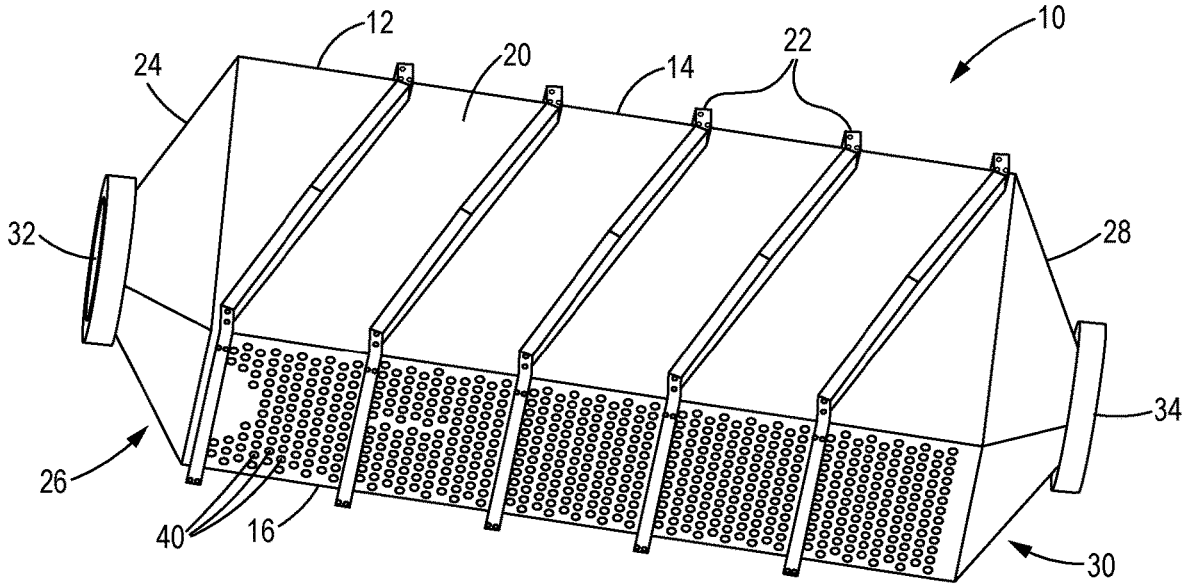
FIG. 2 is a bottom side isometric view of the EGR cooler of FIG. 1.

FIGS. 1 and 2 illustrate an exemplary embodiment of an EGR cooler 10 in which cooling tube arrays in according with the present disclosure may be implemented. The EGR cooler 10 includes an EGR cooler housing 12 having a top wall 14, a bottom wall 16 opposite the top wall 14, a first side wall 18 extending from the top wall 14 to the bottom wall 16, and a second side wall 20 extending from the top wall 14 to the bottom wall 16 opposite the first side wall 18. The EGR cooler housing 12 may further include a plurality of external support ribs 22 that provide further support against mechanical and thermal stresses that may be generated during operation of the EGR system.

The EGR cooler housing 12 further includes an inlet end wall 24 disposed at an inlet end 26 of the EGR cooler 10, and an outlet end wall 28 disposed at an outlet end 30 of the EGR cooler 10 opposite the inlet end 26. The inlet end wall 24 includes an exhaust gas inlet opening 32 that will be fluidly connected to an exhaust manifold (not shown) of an engine (not shown) of a work machine (not shown) by a fluid conduit (not shown) to receive exhaust gas from the exhaust manifold. The outlet end wall 28 includes an exhaust gas outlet opening 34 that will be fluidly connected to an air intake manifold (not shown) of the engine by a fluid conduit (not shown) to communicate cooled exhaust gas to the air intake manifold.

Figure 3:
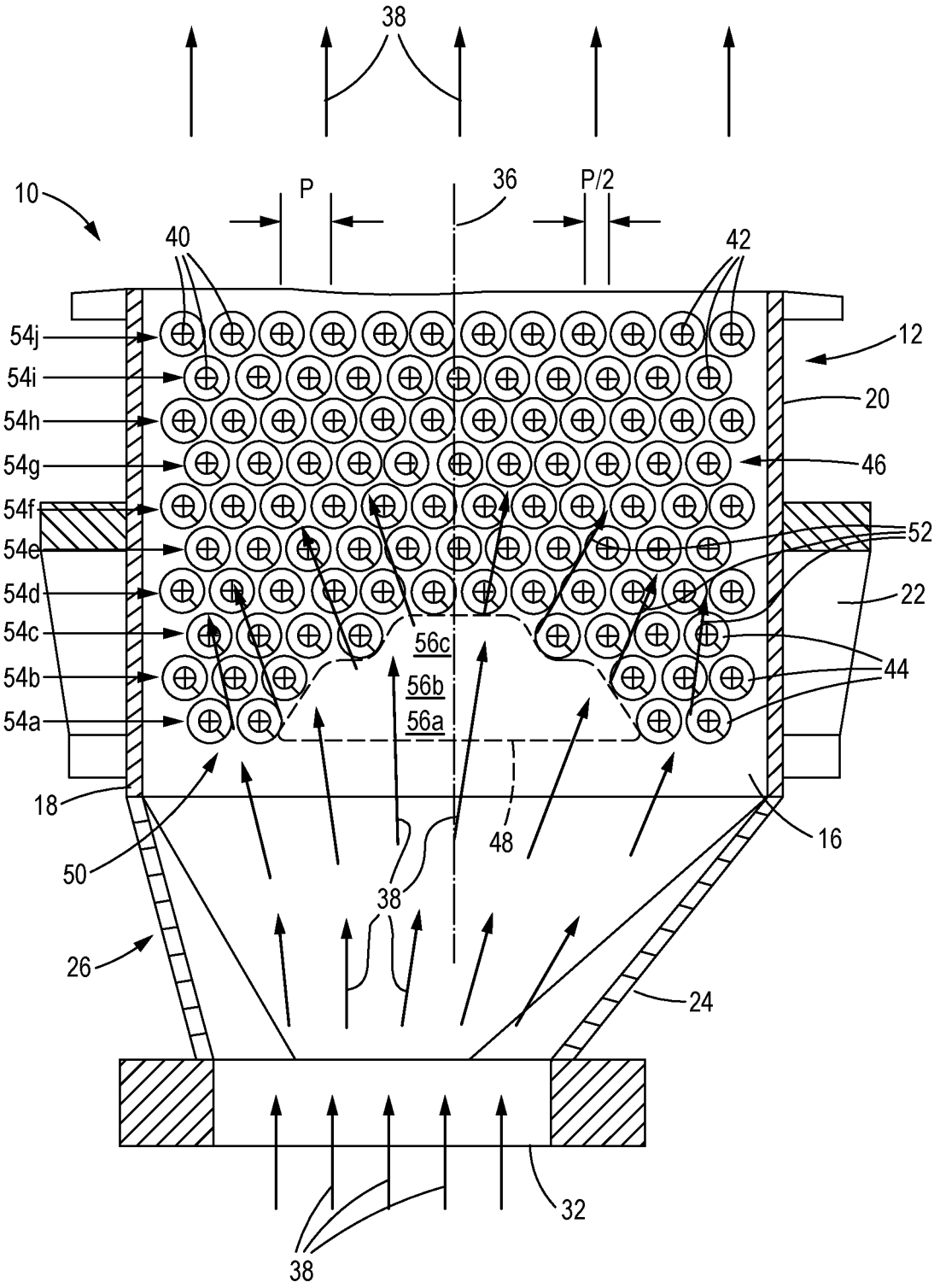
FIG. 3 is a cross-sectional view of the EGR cooler of FIG. 1 taken through line 3-3 and illustrating a first embodiment of a cooling tube array with cooling tubes arranged in accordance with the present disclosure.

The cross-sectional view of FIG. 3 illustrates a portion of the EGR cooler housing 12 proximate the inlet end 26 and the exhaust gas inlet opening 32. The interior of the EGR cooler 10 forms a flow channel for exhaust gases from the exhaust gas inlet opening 32 to the exhaust gas outlet opening 34. The exhaust gas flow generally parallel to an EGR cooler longitudinal axis 36 as indicated by flow arrows 38.

The EGR cooler 10 further includes a plurality of cooling tubes 40 extending through the EGR cooler housing 12 from the top wall 14 to the bottom wall 16 (FIGS. 1 and 2). Each of the cooling tubes 40 has a tube longitudinal axis 42 and is encircled by a helical fin or flange 44 extending from the top wall 14 to the bottom wall 16 to provide additional surface area that promotes heat transfer between a cooling fluid within the cooling tubes 40 and exhaust gas flowing past the cooling tubes 40. In the illustrated embodiment, the plurality of cooling tubes 40 are oriented with the tube longitudinal axes 42 approximately perpendicular to the top wall 14, the bottom wall 16 and the EGR cooler longitudinal axis 36. However, those skilled in the art will understand that the cooling tubes 40 may have other orientations within the EGR cooler housing 12, such as perpendicular to the side walls 18, 20, or at non-perpendicular orientations with respect to the walls 14, 16, 18, 20, while still being arranged to promote heat transfer efficiency in the EGR cooler 10 in accordance with the present disclosure.

In the illustrated embodiment, the cooling tubes 40 are arranged in a cooling tube array 46 when viewed perpendicular to a viewing plane defined by the line 3-3 of FIG. 1 that is parallel to the EGR cooler longitudinal axis 36 and perpendicular to the tube longitudinal axes 42. In this embodiment, the cooling tube array 46 is arranged to form an exhaust gas receiving area 48 having a concave shape at an upstream side 50 of the cooling tube array 46 proximate the inlet end wall 24. With this configuration of the cooling tube array 46 with the exhaust gas receiving area 48 at the upstream side 50 where the exhaust gas first encounters the cooling tube array 46, the exhaust gas flowing into the EGR cooler 10 through the exhaust gas inlet opening 32 will flow into the exhaust gas receiving area 48 that initially provides less resistance to the exhaust gas flow than the cooling tubes 40 at the upstream side 50. The exhaust gas within the exhaust gas receiving area 48 is essentially trapped on three sides by the cooling tubes 40 defining the exhaust gas receiving area 48, and on the upstream side 50 by the exhaust gas continuing to flow into the EGR cooler 10 through the exhaust gas inlet opening 32. The pressure from the upstream exhaust gas on the exhaust gas within the exhaust gas receiving area 48 causes the exhaust gas to disperses from the exhaust gas receiving area 48 through the cooling tube array 46 as indicated by flow arrows 52. The increased flow through the cooling tube array 46 correspondingly reduces flow around the cooling tube array 46 in the areas between the cooling tubes 40 and the side walls 18, 20. More contact occurs between the helical fins 44 of the cooling tubes 40 and the exhaust gas, thereby increasing the heat transfer from the exhaust gas to the cooling fluid in the cooling tubes 40 and correspondingly increasing the efficiency of the EGR cooler 10.

The cooling tube array 46 of FIG. 3 is arranged in a plurality of tube rows 54*a*-54*j* that are perpendicular to the EGR cooler longitudinal axis 36. The cooling tubes 40 of each of the plurality of tube rows 54*a*-54*j* are spaced from each adjacent cooling tube 40 by a pitch distance P between their tube longitudinal axes 42. Each tube row 54*a*-54*j* is offset from the adjacent tube rows 54*a*-54*j* in a direction perpendicular to the EGR cooler longitudinal axis 36 by a row offset distance P/2 that is approximately equal to one-half the pitch distance P. Aside from the spaces defining the exhaust gas receiving area 48, the tube rows 54*b*, 54*d*, 54*f*, 54*h*, 54*j* have one more cooling tube 40 and are correspondingly wider than the alternate tube rows 54*a*, 54*c*, 54*e*, 54*g*, 54*i*. In alternative embodiments, the tube rows 54*a*-54*j* may be aligned one tube row 54*a*-54*j* behind the next in the axial direction of the EGR cooler 10. Moreover, whether aligned or offset, the tube rows 54*a*-54*j* could each include the same number of cooling tube 40 and have a constant width. Further alternative arrangements of the cooling tube arrays 46 having varying combinations of tube rows, cooling tube 40 within rows, alignment and offset of tube rows and other relative positions of the cooling tubes 40 allowing for the definition of exhaust gas receiving areas 48 within EGR cooler 10 in accordance with the present disclosure are contemplated by the inventors.

Exhaust gas receiving areas 48 such as that formed in the cooling tube array 46 in FIG. 3 may be defined by row spaces 56*a*-56*c* without cooling tubes 40 in at least the first tube row 54*a* at the upstream side 50 of the cooling tube array 46. The first tube row 54*a* has the first row space 56*a* omitting seven cooling tubes 40 proximate the center of the first tube row 54*a*. The second tube row 54*b* immediately downstream of the first tube row 54*a* has the second row space 56*b* omitting one fewer cooling tube 40, or six total cooling tubes 40. Consequently, the second row space 56*b* is narrower than the first row space 56*a*, and the first row space 56*a* and the second row space 56*b* begin to define the concave shape of the exhaust gas receiving area 48. The third tube row 54*c* immediately downstream of the second tube row 54*b* includes the third row space 56*c* omitting three fewer cooling tubes 40, or three total cooling tubes 40, so that the third row space 56*c* is still narrower than the second row space 56*b* with the row spaces 56*a*-56*c* defining the exhaust gas receiving area 48 with a generally curved shape. As shown, the exhaust gas receiving area 48 is centered within the EGR cooler housing 12 on the EGR cooler longitudinal axis 36. However, the exhaust gas receiving area 48 could be offset from the EGR cooler longitudinal axis 36 if necessary to optimize the efficiency of the EGR cooler. In further alternate embodiments, the sizes of the row spaces 56*a*-56*c* can be varied, and additional row spaces 56 can be provided in downstream tube rows 54*d*-54*j* as necessary to provide exhaust gas receiving areas sized, shaped and positioned to meet requirements for a particular implementation in the EGR cooler 10.

Figure 4:
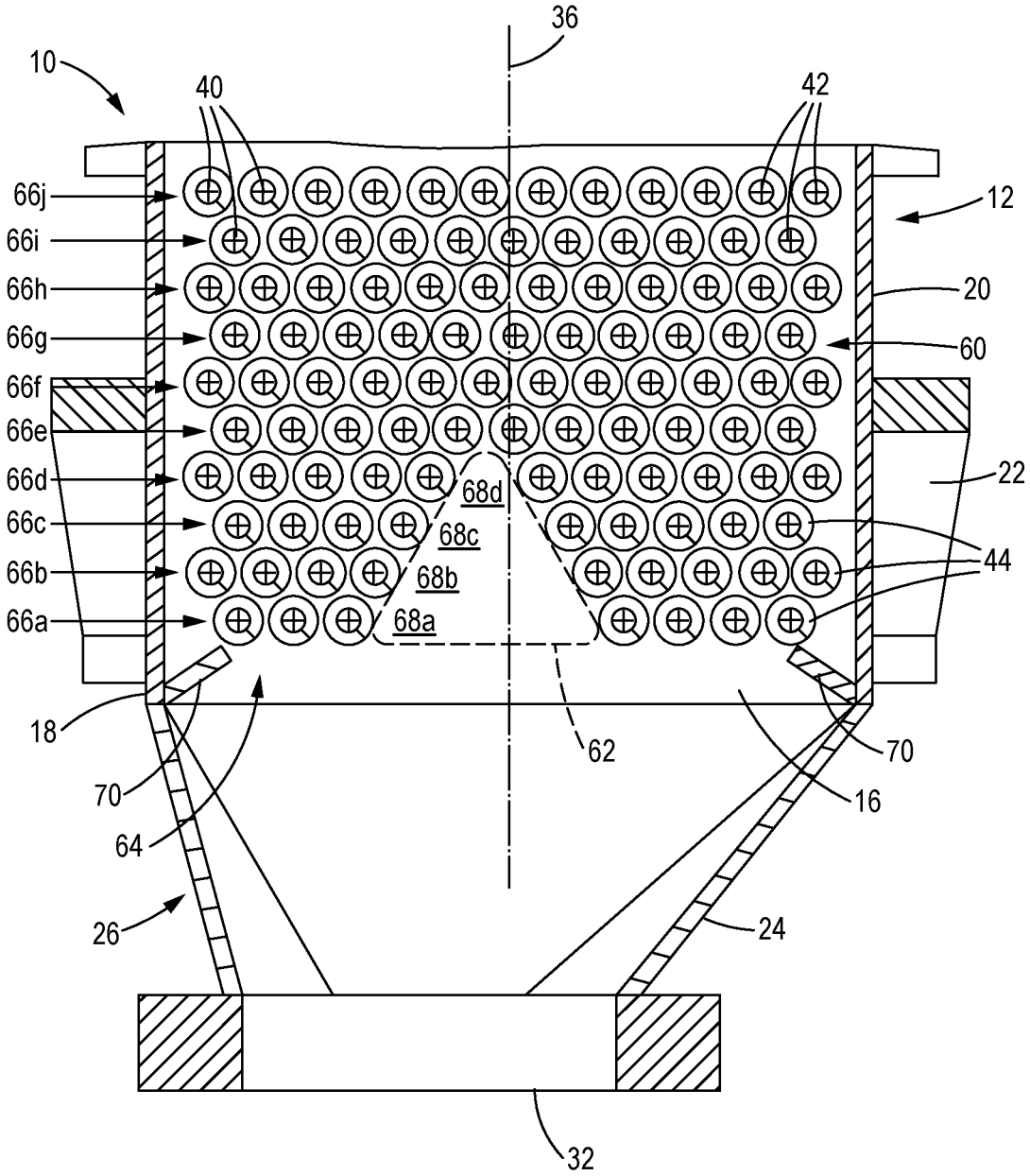
FIG. 4 is the cross-sectional view of the EGR cooler of FIG. 3 illustrating an alternative embodiment of a cooling tube array with cooling tubes arranged in accordance with the present disclosure.

FIG. 4 illustrates an alternative embodiment of a cooling tube array 60 in accordance with the present disclosure formed by the cooling tubes 40 within the EGR cooler housing 12. In this embodiment, the cooling tube array 60 is arranged to form an exhaust gas receiving area 62 with a triangular shape at an upstream side 64 of the cooling tube array 60 proximate the inlet end wall 24. Similar to the cooling tube array 46, the cooling tube array 60 is arranged in a plurality of tube rows 66*a*-66*j* that are perpendicular to the EGR cooler longitudinal axis 36 with adjacent tube rows 66*a*-66*j* being offset by one-half the pitch distance P. A first row space 68*a* in the first tube row 66*a* has a first row space width equal to a first amount of omitted cooling tubes 40, with the first row space width being equal to four cooling tube 40 placed side-by-side. A second row space 68*b* in a second tube row 66*b* immediately downstream of the first tube row 66*a* has a second row space width equal the first amount of omitted cooling tubes 40 less one cooling tube 40, or three total cooling tubes 40. Row spaces 68*c*, 68*d* in each of subsequent tube rows 66*c*, 66*d* have row space widths equal to one less cooling tube 40 than an immediate upstream tube row 66*b*, 66*c* until there is no row space at a fifth tube row 66*e* in the illustrated embodiment. The row spaces 68*a*-68*d* define the exhaust gas receiving area 62 with a triangular shape and being partially offset from the EGR cooler longitudinal axis 36. In alternative embodiments, the exhaust gas receiving are 62 may be aligned on the EGR cooler longitudinal axis 36, and may be larger or smaller than shown by varying the row space widths of the row spaces 68*a*-68*d* and providing row spaces in more or fewer of the tube rows 66*a*-66*j* as necessary to meet the requirements for a particular implementation of the EGR cooler 10. FIG. 4 further illustrates that baffles 70 mounted within the EGR cooler housing 12 proximate the upstream side 64 of the cooling tube array 60 and oriented to direct exhaust gas entering the EGR cooler housing 12 through the exhaust gas inlet opening 32 away from the side walls 18, 20 and toward the exhaust gas receiving area 62. The baffles 70 may be implemented in any EGR cooler 10 having cooling tube arrays as illustrated and described herein, or the baffles 70 may be omitted if necessary to achieve a desired exhaust gas flow and cooler efficiency.

Figure 5:
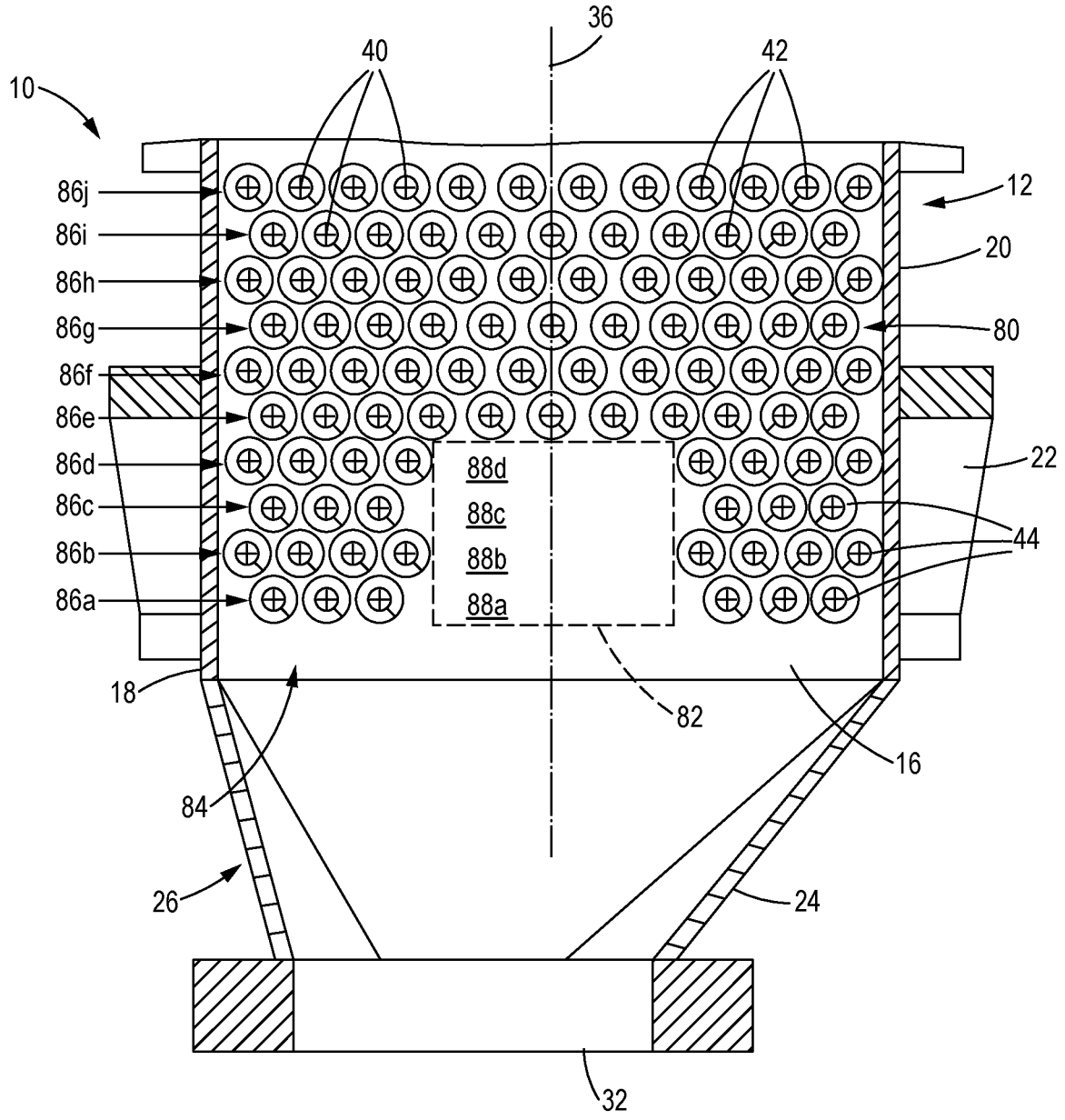
FIG. 5 is the cross-sectional view of the EGR cooler of FIG. 3 illustrating another alternative embodiment of a cooling tube array with cooling tubes arranged in accordance with the present disclosure.

Other configurations of cooling tube arrays are contemplated having exhaust gas receiving areas with varying geometries. In some embodiments, the exhaust gas receiving area does not necessarily decrease in width as the exhaust gas receiving area extends inward into the cooling tube array from the upstream side. For example, FIG. 5 illustrates the EGR cooler 10 having a cooling tube array 80 with an exhaust gas receiving area 82 at an upstream end 84 with a generally square or rectangular shape. A plurality of tube rows 86*a*-86*j* define the cooling tube array 80 in a similar manner as described in the embodiments above. A plurality of row spaces 88*a*-88*d* in the corresponding tube rows 86*a*-86*d* extend into the cooling tube array 80 without substantially changing a width of the exhaust gas receiving area 82. Due to the offset of the tube rows 86*a*-86*j*, the alternate row spaces 88*b*, 88*d* may omit one additional cooling tube 40 from the corresponding tube rows 86*b*, 86*d* than the adjacent row spaces 88*a*, 88*c* to define the shape of the exhaust gas receiving area 82.

Figure 6:
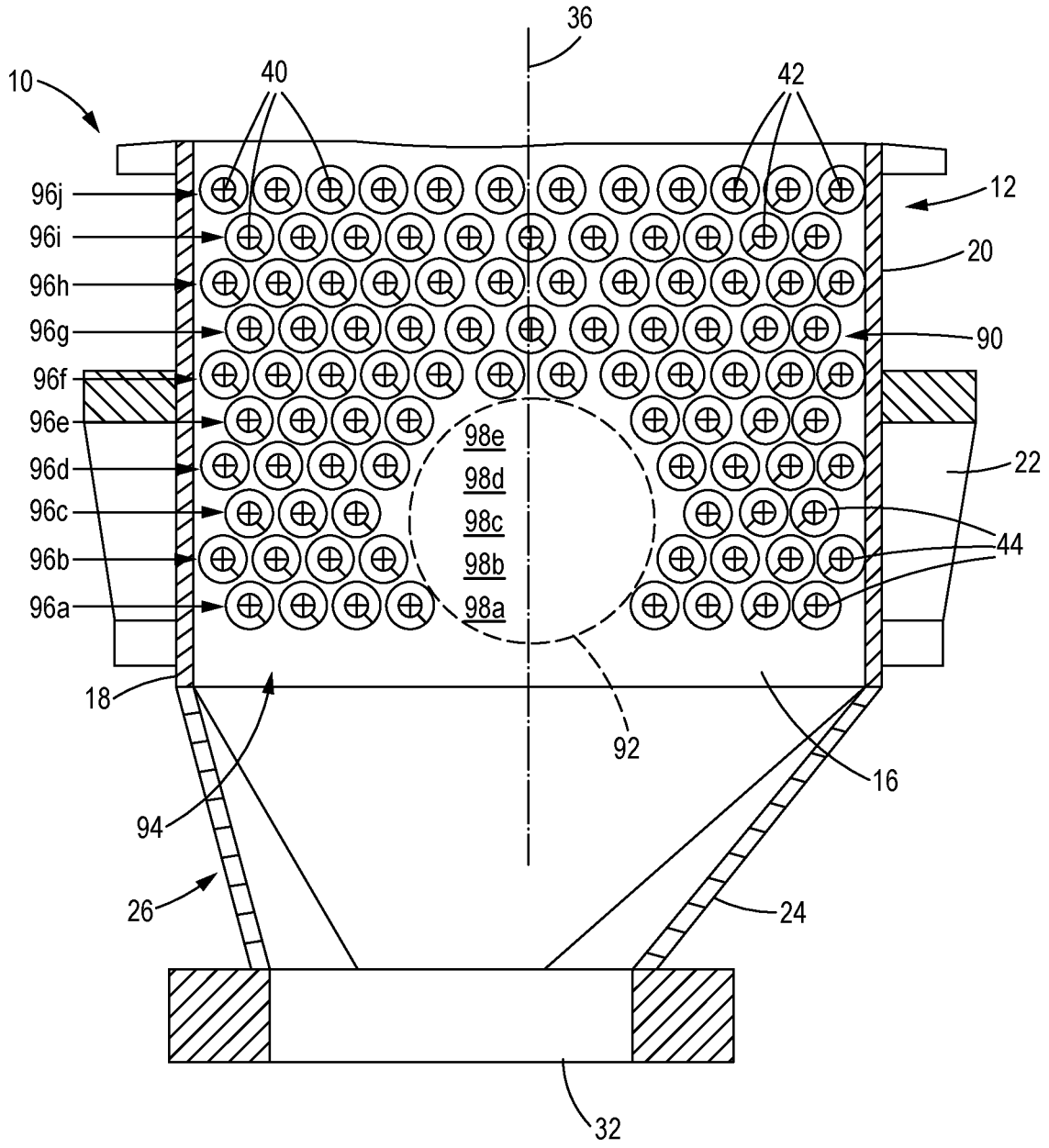
FIG. 6 is the cross-sectional view of the EGR cooler of FIG. 3 illustrating a still further alternative embodiment of a cooling tube array with cooling tubes arranged in accordance with the present disclosure.

In another alternative embodiment of a cooling tube array 90 illustrated in FIG. 6, an exhaust gas receiving area 92 may have a generally circular or hexagonal shape. A width of the exhaust gas receiving area 92 initially increases as the exhaust gas receiving area 92 extends inward from an upstream end 94, and then decreases in width to form the circular or hexagonal shape of the exhaust gas receiving area 92. The cooling tube array 90 includes a plurality of tube rows 96*a*-96*j* having row spaces 98*a*-98*e* defining the exhaust gas receiving area 92. The first tube row 96*a* has a first row space 98*a* omitting three cooling tubes 40 proximate the EGR cooler longitudinal axis 36. The second row space 98*b* and the third row space 98*c* omit one additional cooling tube 40 relative to the immediate upstream row spaces 98*a*, 98*b* to widen the exhaust gas receiving area 92 as it initially extends inward. The fourth row space 98*d* and the fifth row space 98*e* omit one fewer cooling tubes 40 relative to the immediate upstream row spaces 98*c*, 98*d* to narrow the exhaust gas receiving area 92 and thereby form the circular or hexagonal shape of the exhaust gas receiving area 92.

Figure 7:
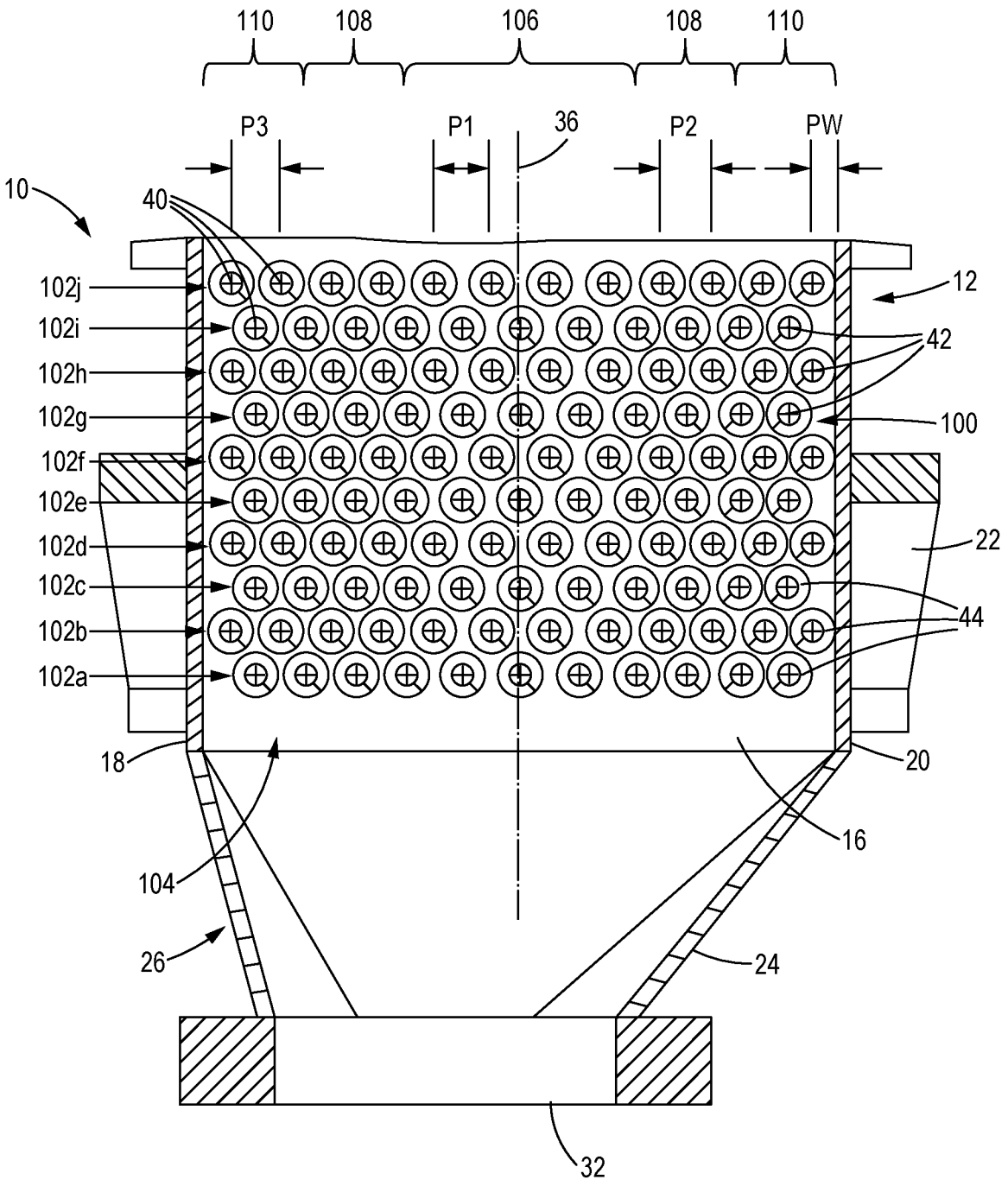
FIG. 7 is the cross-sectional view of the EGR cooler of FIG. 3 illustrating a further embodiment of a cooling tube array with cooling tubes arranged in accordance with the present disclosure.

FIG. 7 illustrates a further alternative embodiment of a cooling tube array 100 in accordance with the present disclosure wherein the cooling tubes 40 are arranged to promote flow of the exhaust gas through cooling tube array 100 instead of around the cooling tube array 100 and past the side walls 18, 20. The cooling tube array 100 is arranged in a plurality of tube rows 102*a*-102*j* that are perpendicular to the EGR cooler longitudinal axis 36 with the cooling tubes 40 of each of the plurality of tube rows 102*a*-102*j* being spaced from each adjacent cooling tube 40 by a pitch distance P between their tube longitudinal axes 42. The cooling tube array 100 as illustrated does not include an exhaust gas receiving area at an upstream side 104 as shown for the cooling tube arrays 46, 60, 80, 90. Instead, to promote flow of exhaust gas through the cooling tube array 100, the cooling tube array 100 has a first cooling tube array section 106 proximate and centered on the EGR cooler longitudinal axis 36 where the pitch distance P between the adjacent cooling tubes 40 in the first cooling tube array section is equal to a first pitch distance P1. The cooling tube array 100 further includes a pair of second cooling tube array sections 108, with the second cooling tube array sections 108 being disposed on either side of the first cooling tube array section 106, and each second cooling tube array section 108 being disposed between the first cooling tube array section 106 and a corresponding one of the side walls 18, 20.

The pitch distance P between the adjacent cooling tubes 40 in the pair of second cooling tube array sections 108 is equal to a second pitch distance P2 that is less than the first pitch distance P1. Due the differences in the pitch distances P1, P2, the exhaust gas experiences less resistance through the first cooling tube array section 106. This results in a greater amount of exhaust gas flow through the cooling tube array 100 than in cooling tube arrays where the cooling tubes 40 are evenly spaced across the width of the EGR cooler housing 12 and meaningful portions of the exhaust gas flows around the previous cooling tube arrays. To further promote exhaust gas flow within the cooling tube array 100, the cooling tube array 100 further includes a pair of third cooling tube array sections, with each third cooling tube array section 110 being disposed between one of the pair of second cooling tube array sections 108 and the corresponding one of the side walls 18, 20. The pitch distance P between the adjacent cooling tubes 40 in the pair of third cooling tube array sections 110 is equal to a third pitch distance P3 that is less than the second pitch distance P2 and the first pitch distance P1. Flow of exhaust gas around the cooling tube array 100 and between the outermost cooling tubes 40 and the side walls 18, 20 may be further discouraged by making a wall separation distance PW between the tube longitudinal axes 42 of the transversely outermost cooling tubes 40 and inner surface of the corresponding one of the side walls 18, 20 less than the pitch distances P1, P2, P3.

INDUSTRIAL APPLICABILITY

The configurations of the cooling tube arrays 46, 60, 80, 90, 100 in accordance with the present disclosure as illustrated and described herein can increase the efficiency of the EGR cooler 10 by causing the exhaust gas flowing there through the EGR cooler housing 12 to flow past the cooling tubes 40 instead of around the cooling tube arrays 46, 60, 80, 90, 100. The increased central flow and gas-to-tube contact correspondingly increases the heat transfer from the exhaust gas to the cooling fluid. The precise configurations of cooling tube arrays in accordance with the present disclosure and combinations thereof can be varied to meet the requirements for a particular implementation of the EGR coolers 10, and such configurations and combinations are contemplated by the inventors. For example, exhaust gas receiving areas can have other geometric configurations and positioning relative to the EGR cooler longitudinal axis 36 to achieve optimal flow through the cooling tube arrays. Cooling tube arrays can be divided into greater or fewer cooling tube array sections, and have varying relative spacing between adjacent cooling tubes 40. Moreover, exhaust gas receiving areas and cooling tube array sections could be implemented in the same cooling tube array, and the cooling tubes 40 need not be arranged in rows perpendicular to the EGR cooler longitudinal axis 36 as shown in the various embodiments. Further alternative geometric configurations of the cooling tubes 40 to promote flow through and not around the cooling tube arrays may be apparent to those skilled in the art and are contemplated by the inventors.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. An exhaust gas recirculation (EGR) cooler comprising:

an EGR cooler housing comprising:

a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of an exhaust gas flow from the inlet end to the outlet end; and a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes, wherein the cooling tube array is arranged to form an exhaust gas receiving area at an upstream side of the cooling tube array proximate the inlet end wall so that exhaust gas flowing into the EGR cooler through the exhaust gas inlet opening will flow into the exhaust gas receiving area and then disperse through the cooling tube array, wherein the cooling tube array is arranged in a plurality of tube rows that are perpendicular to the EGR cooler longitudinal axis with the plurality of cooling tubes of each of the plurality of tube rows being spaced from each adjacent cooling tube by a pitch distance between their tube longitudinal axes, wherein a first tube row at the upstream side of the cooling tube array has a first row space without cooling tubes and a second tube row immediately downstream of the first tube row has a second row space without cooling tubes, wherein the second row space is narrower than the first row space and the exhaust gas receiving area is defined by the first row space and the second row space.

2. The EGR cooler of claim 1, wherein the exhaust gas receiving area is centered on the EGR cooler longitudinal axis.

3. The EGR cooler of claim 1, wherein a third tube row immediately downstream of the second tube row has a third row space without cooling tubes, wherein the third row space is narrower than the second row space and the exhaust gas receiving area is defined by the first row space, the second row space and the third row space.

4. The EGR cooler of claim 1, wherein the cooling tube array is arranged in a plurality of tube rows that are perpendicular to the EGR cooler longitudinal axis with the plurality of cooling tubes of each of the plurality of tube rows being spaced from each adjacent cooling tube by a pitch distance between their tube longitudinal axes, wherein each tube row is offset from an adjacent tube row in a direction perpendicular to the EGR cooler longitudinal axis by a row offset distance equal to approximately one-half the pitch distance, and wherein the exhaust gas receiving area is defined by row spaces without cooling tubes in at least a first tube row at the upstream side of the cooling tube array.

5. The EGR cooler of claim 4, wherein a first row space in the first tube row has a first row space width equal to a first amount of omitted cooling tubes, and wherein a second row space in a second tube row immediately downstream of the first tube row has a second row space width equal the first amount of omitted cooling tubes less one cooling tube, and wherein the exhaust gas receiving area is defined by the first row space and the second row space.

6. The EGR cooler of claim 5, wherein a third row space in a third tube row immediately downstream of the second tube row has a third row space width equal the first amount of omitted cooling tubes less four cooling tubes, and wherein the exhaust gas receiving area is defined by the first row space, the second row space and the third row space.

7. The EGR cooler of claim 4, wherein a first row space in the first tube row has a first row space width equal to a first amount of omitted cooling tubes, wherein a second row space in a second tube row immediately downstream of the first tube row has a second row space width equal the first amount of omitted cooling tubes less one cooling tube, wherein the row spaces in each of subsequent tube rows have row space widths of one less cooling tube than an immediate upstream tube row until a row space width is equal to zero, and wherein the exhaust gas receiving area is defined by the row spaces of the tube rows having tube spaces such that the exhaust gas receiving area has a triangular shape.

8. The EGR cooler of claim 1, wherein the exhaust gas receiving area has a triangular shape.

9. An exhaust gas recirculation (EGR) cooler comprising:

an EGR cooler housing comprising:

a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of an exhaust gas flow from the inlet end to the outlet end;

a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes, wherein the cooling tube array is arranged in a plurality of tube rows that are perpendicular to the EGR cooler longitudinal axis with the plurality of cooling tubes of each of the plurality of tube rows being spaced from each adjacent cooling tube by a pitch distance between their tube longitudinal axes; and a plurality of baffles mounted within the EGR cooler housing proximate an upstream side of the cooling tube array proximate the inlet end wall and oriented to direct exhaust gas entering the EGR cooler housing through the exhaust gas inlet opening away from the first side wall and the second side wall and toward the first cooling tube array section, wherein the cooling tube array comprises:

a first cooling tube array section proximate the EGR cooler longitudinal axis, wherein the pitch distance between adjacent cooling tubes in the first cooling tube array section is equal to a first pitch distance, and a pair of second cooling tube array sections, with each second cooling tube array section being disposed between the first cooling tube array section and a corresponding one of the first side wall and the second side wall, and wherein the pitch distance between the adjacent cooling tubes in the pair of second cooling tube array sections is equal to a second pitch distance that is less than the first pitch distance.

10. The EGR cooler of claim 9, wherein the first cooling tube array section is centered on the EGR cooler longitudinal axis.

11. The EGR cooler of claim 9, wherein the cooling tube array comprises a pair of third cooling tube array sections, with each third cooling tube array section being disposed between one of the pair of second cooling tube array sections and the corresponding one of the first side wall and the second side wall, and wherein the pitch distance between the adjacent cooling tubes in the pair of third cooling tube array sections is equal to a third pitch distance that is less than the second pitch distance.

12. The EGR cooler of claim 9, wherein the first pitch distance is greater than a wall separation distance between the tube longitudinal axis of a transversely outermost cooling tube and an inner surface of the corresponding one of the first side wall and the second side wall.

13. An exhaust gas recirculation (EGR) cooler comprising:

an EGR cooler housing comprising:

a top wall, a bottom wall opposite the top wall, a first side wall extending from the top wall to the bottom wall, a second side wall extending from the top wall to the bottom wall opposite the first side wall, an inlet end wall disposed at an inlet end of the EGR cooler and having an exhaust gas inlet opening, and an outlet end wall disposed at an outlet end of the EGR cooler opposite the inlet end and having an exhaust gas outlet opening, wherein an EGR cooler longitudinal axis extends in a direction of exhaust gas flow from the inlet end to the outlet end; and a plurality of cooling tubes extending through the EGR cooler housing from the top wall to the bottom wall with each having a tube longitudinal axis, the plurality of cooling tubes being arranged in a cooling tube array when viewed perpendicular to a viewing plane that is parallel to the EGR cooler longitudinal axis and perpendicular to the tube longitudinal axes, wherein a first tube row at the upstream side of the cooling tube array has a first row space without cooling tubes and a second tube row immediately downstream of the first tube row has a second row space without cooling tubes, wherein the second row space is narrower than the first row space and the exhaust gas receiving area is defined by the first row space and the second row space, wherein the cooling tube array is arranged to form an exhaust gas receiving area at an upstream side of the cooling tube array proximate the inlet end wall so that exhaust gas flowing into the EGR cooler through the exhaust gas inlet opening will flow into the exhaust gas receiving area and then disperse through the cooling tube array, and wherein the cooling tube array is arranged in a plurality of tube rows that are perpendicular to the EGR cooler longitudinal axis with the plurality of cooling tubes of each of the plurality of tube rows being spaced from each adjacent cooling tube by a pitch distance between their tube longitudinal axes, wherein the cooling tube array comprises:

a first cooling tube array section proximate the EGR cooler longitudinal axis, wherein the pitch distance between adjacent cooling tubes in the first cooling tube array section is equal to a first pitch distance, and a pair of second cooling tube array sections, with each second cooling tube array section being disposed between the first cooling tube array section and a corresponding one of the first side wall and the second side wall, and wherein the pitch distance between the adjacent cooling tubes in the pair of second cooling tube array sections is equal to a second pitch distance that is less than the first pitch distance.

14. The EGR cooler of claim 13, wherein a third tube row immediately downstream of the second tube row has a third row space without cooling tubes, wherein the third row space is narrower than the second row space and the exhaust gas receiving area is defined by the first row space, the second row space and the third row space.

15. The EGR cooler of claim 13, wherein the cooling tube array comprises a pair of third cooling tube array sections, with each third cooling tube array section being disposed between one of the pair of second cooling tube array sections and the corresponding one of the first side wall and the second side wall, and wherein the pitch distance between the adjacent cooling tubes in the pair of third cooling tube array sections is equal to a third pitch distance that is less than the second pitch distance.

16. The EGR cooler of claim 13, wherein a first tube row at the upstream side of the cooling tube array has a first row space without cooling tubes and a second tube row immediately downstream of the first tube row has a second row space without cooling tubes, wherein the second row space is wider than the first row space and the exhaust gas receiving area is defined by the first row space and the second row space.

* * * * *